United States Patent [19]

Johansson et al.

[11] Patent Number: 4,621,881

[45] Date of Patent: Nov. 11, 1986

[54] CONNECTION DEVICE IN AN IGNITION SYSTEM

[75] Inventors: Sven H. Johansson; Jan G. Nytomt, both of Åmål, Sweden

[73] Assignee: Saab-Scania Aktiebolag, Sodertalje, Sweden

[21] Appl. No.: 719,273

[22] PCT Filed: Jun. 28, 1984

[86] PCT No.: PCT/SE84/00244

§ 371 Date: Apr. 2, 1985

§ 102(e) Date: Apr. 2, 1985

[87] PCT Pub. No.: WO85/00931

PCT Pub. Date: Feb. 28, 1985

[30] Foreign Application Priority Data

Aug. 5, 1983 [SE] Sweden ..... 8304282

[51] Int. Cl.[4] ..... H01R 13/44

[52] U.S. Cl. ..... 339/26; 339/149 S; 339/213 S; 174/138 S

[58] Field of Search ..... 339/26, 213 S, 217 SP, 339/218 S, 223 S, 143 S, 149 S, 115 R, 115 C, 117 R, 27; 174/138 S

[56] References Cited

U.S. PATENT DOCUMENTS

| | | | |
|---|---|---|---|
| 2,113,735 | 4/1938 | Mascuch | 339/26 |
| 3,128,139 | 4/1964 | Estes | 339/26 |
| 4,221,452 | 9/1980 | Remington | 339/26 |

*Primary Examiner*—Gil Weidenfeld
*Assistant Examiner*—Thomas M. Kline
*Attorney, Agent, or Firm*—Cushman, Darby & Cushman

[57] ABSTRACT

A connection device in an ignition system for transferring current to the spark plugs of an internal combustion engine includes a comparatively rigid outer sleeve intended to surround an upper portion of a spark plug, a contact for conductive communication with a central electrode of the spark plug, an elastic inner sleeve surrounded by the outer sleeve for tightly sealing against the upper portion of the spark plug when the connection device is fitted to the spark plug, a space being formed between the outer sleeve and the inner sleeve for allowing radial expansion of the inner sleeve, the outer sleeve and the inner sleeve having lower portions which include coacting portions for transferring force between the outer and inner sleeves, whereby for an upwardly directed force on the connection device fitted to the spark plug, force is transferred from the outer sleeve to the inner sleeve, and causes the inner sleeve to relinquish the spark plug.

7 Claims, 2 Drawing Figures

CONNECTION DEVICE IN AN IGNITION SYSTEM

Figure 1:
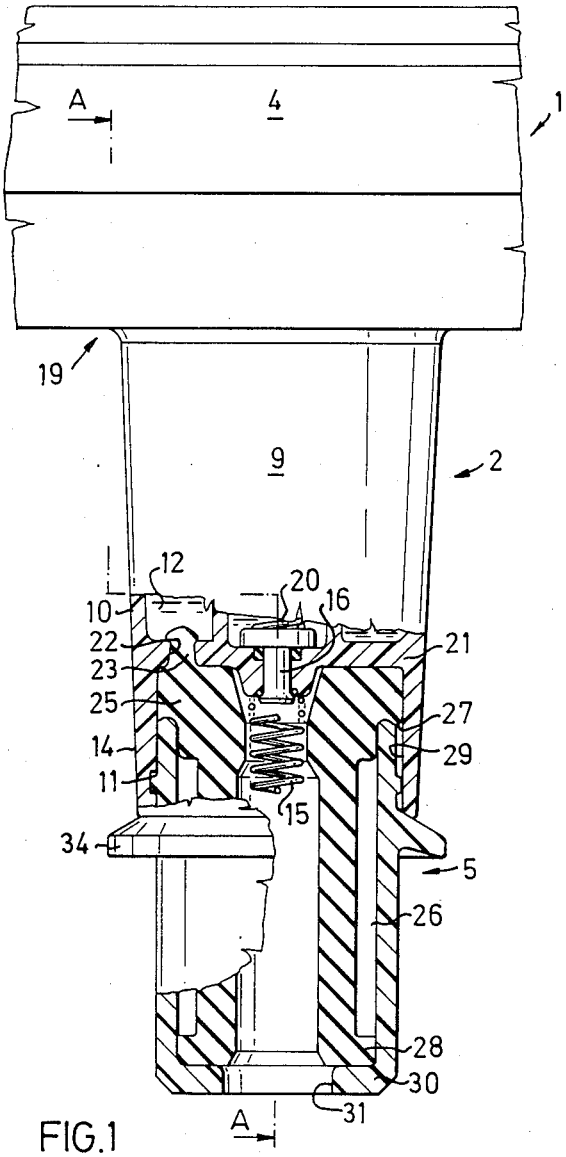

The present invention relates to a connection device in an ignition system for transferring high-tension current to the spark plugs of an internal combustion engine, each connection device including a comparatively rigid outer sleeve intended to surround the upper portion of a spark plug, to obtain conductive communication with a central electrode of the spark plug via a contact means disposed in the connection device.

It is already known to form a connection device between a spark plug and an ignition cable as a rigid sleeve which is thrust over the upper portion of the spark plug, i.e. the spark plug insulator, a spring arranged in the sleeve being caused to snap round the outer end of the central electrode of the spark plug. There is thus obtained contact between the electrode and a contact tab at the bottom of the sleeve, this tab being in conductive communication with the ignition cable. In such a case, there is a certain gap between the spark plug and the sleeve, resulting in that dirt and moisture can get in and negatively affect the transmission of high-tension current to the spark plug.

With the aim of preventing this disadvantage, it is known to form the sleeve surrounding the spark plug from an elastic material which tightly surrounds the spark plug when the sleeve is thrust over it. Such an elastic sleeve is difficult to remove from the spark plug, however, since the grip appears to increase with increased application of force. There is thus required a considerable force to remove the connection device.

The present invention has the task of implementing a connection device for ignition systems, which allows simple handling and reliable voltage transmission in practical use. To this end, the inventive connection device includes an elastic inner sleeve enclosed by the outer sleeve, the inner sleeve being adapted to sit tightly round the upper portion of the spark plug when the connection device is fitted thereto. There is thus formed a space for radial expansion of the inner sleeve between the outer sleeve and the inner sleeve, and the invention is characterized by the lower portions of the outer and inner sleeves including portions coacting for force transfer between the sleeves, whereby for an upwardly directed force on a connection device fitted to a spark plug, force is transferred to the inner sleeve and causes it to expand radially so that its grip round the plug decreases.

The tendency mentioned in the introduction for the sleeve to more tightly grip round the spark plug when the connection device is removed, is thus prevented by a connection device in accordance with the present invention. With the inventive implementation, the outer sleeve acts on the elastic inner sleeve with a force from below and outwards, thereby limiting the ability of the inner sleeve to stretch because of friction forces relative the spark plug. This means that the removal force can be kept at a suitably low level.

In a preferred embodiment of the invention, the outer sleeve is formed at its lower end with a flange directed radially inwardly, this flange coacting axially with a radially outwardly directed flange on the lower end of the inner sleeve when the connection device is to be removed from the spark plug.

Figure 2:
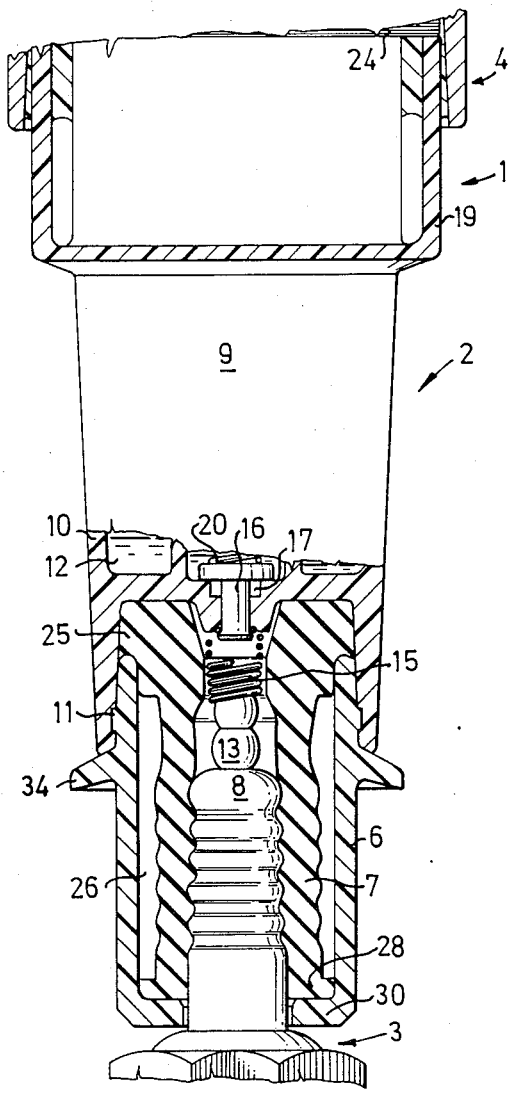

Further distinguishing features of the invention are disclosed in the appended claims and following description of a preferred embodiment of the invention. The description is made with reference to accompanying figures, of which FIG. 1 is a longitudinal section through an inventive connection device, and FIG. 2 illustrates the connection device fitted to a spark plug.

The exemplified connection device is included in an ignition unit 1 of the principal kind which is explained in detail in our Swedish Patent Application No. 8204248-2. In the ignition unit 1 there are a plurality of connection devices 5, corresponding to the number of spark plugs 3 in the engine in question. Each connection device 5 is connected to a common upper part 4 of the ignition unit. The ignition unit 1 is rigidly mounted on the engine (not shown), via the upper part 4, which enables reliable contact formation between the connection devices 5 and the respective spark plugs 3.

With a straight four-cylinder engine, the ignition unit 1 has four connection devices 5. Each of them is integrated in the outer end of a connection piece 2, dependent from the upper part 4 of the ignition unit. All the connection devices 5 can be simultaneously fitted to and removed from the spark plugs 3 via the ignition unit 1, which may be handled as a unit.

The upper portion of each connection piece 2 comprises an ignition element 9 with a conical outer casing 10, to the lower extended part 14 of which a connection device 5 is connected with the aid of a snap-on joint 11 or the like. The connection device 5 includes a protective outer sleeve 6 of stiff material, e.g. polyamide plastics, this outer sleeve 6 coacting with an interiorly placed elastic inner sleeve 7. The latter can be made from rubber, e.g. silicone rubber, which flexibly closes tightly round the insulator part 8 of the spark plug 3 when it is fitted to the spark plug.

The outer casing 10 accommodates a closed chamber 12 including an unillustrated ignition coil enclosed in insulating oil. The upper portion of the casing 10 protects the connection of the ignition coil to a circuit board 24 arranged in the upper part 4. The circuit board 24 as well as the upper portion of the casing 10 are, for all the ignition coils included in the ignition unit, embedded in epoxy plastics in the upper part 4, whereby an extremely reliable connection is obtained. In the illustrated embodiment, all the casings 10 for connection pieces 2 included in the ignition unit 1 are part of a common cover 19.

The ignition coil in the chamber 12 is connected to a contact means 15 engaging against the central electrode 13 of the spark plug and transmitting ignition voltage. The contact means is here a helical spring, the upper end of which being retained in a spring seating made on a rivet 16 which goes through the bottom 21 of the chamber 21. A seal 17 prevents oil leakage via the rivet hole. The head of the rivet 16 in the chamber 12 constitutes the lower abutment for a helical spring 20 accommodated in the chamber 12, this spring having direct communication with the secondary winding of the ignition coil.

As is apparent from FIG. 1, the bottom 21 of the chamber is provided with an opening 22 through which the chamber 12 is filled with and emptied of oil. The opening is closed by a plug 23 formed for the purpose, and which is a part of the inner sleeve 7. The plug 23 is guided into position for the opening 22 by a shoulder portion 25 on the inner sleeve 7 being formed with an outwardly directed ridge 27 coacting with a guide groove 29 in the lower part 14 of the element casing 10.

The inner sleeve 7 is pressed against the ignition element 9 by the outer sleeve 6, on being attached to the element 9, acting on the shoulder portion 25 of the inner sleeve 7 with an upwardly directed force. Below the shoulder portion 25 there is a space between the inner sleeve 7 and the outer sleeve 6, whereby expansion of the inner sleeve 7 is enabled when it is pushed over the spark plug 3.

The inner diameter of the inner sleeve 7 is less than the diameter of the spark plug insulator 8 by more than 20% with the object of ensuring a good seal between the inner sleeve 7 and the spark plug 3. Depending on the rubber quality of the inner sleeve 7, the mentioned dimension difference may be up to 50% so as to provide for the intended sealing action.

A radially outwardly directed flange 28 terminates the lower end of the inner sleeve 7. The flange 28 has a substantially axially downwardly directed surface which engages against a complemental surface on a radially inwardly directed flange 30 of the outer sleeve 6. The flange 30 defines a central opening 31, the dimension of which is greater than the diameter of the insulator portion 8 of the spark plug 3. The outer sleeve 6 is also provided with an outwardly directed flange 34 which prevents water, dirt and other contaminants from gaining access to an unillustrated spark plug well on the engine block. Furthermore, the flange 34 constitutes an abutment for the possible amount of penetration of the outer sleeve 6 into the element casing 10. The position of the abutment is also selected so that the compression force of the outer sleeve 6 on the shoulder portion 25 of the inner sleeve 7 is given a predetermined value.

It will be seen from FIG. 2 that the inner sleeve 7 is deformed when the connection piece 2 is mounted on the spark plug 3. The degree of deformation determines the mounting force and the effectiveness of the seal. In removing the connection piece 2 from the spark plug 3, friction and the radial contraction tension in the inner sleeve 7 prevent initial upward movement of the inner sleeve 7. The friction force which is counter to the withdrawing force is finally compensated by the axial force which is transferred from the outer sleeve 6 to the inner sleeve 7 via their lower flanges 28 and 30, whereby the inner sleeve 7 relinquishes the spark plug 3 to allow removal of the connection piece 2.

The embodiment described above is not to be considered restricting to the invention, and within the scope of the following claims, the invention can be modified in a plurality of embodiments. The invention may of course be utilized just as well for separately handleable connection devices as for connection devices included in an ignition unit or the like. The lesser removal force might, however, be of greater importance in the latter case.

The constructional elements included in the invention can also be varied in many different ways while retaining the inventive force coaction in removal from the spark plug. Accordingly, the outer sleeve does not need to be made as a completely enveloping cylindrical sleeve, and it may be replaced by a gripping element transferring axial withdrawal force to the inner sleeve. The mutually opposed force-transferring surfaces on the outer and inner sleeves may similarly be formed differently for transferring the necessary withdrawal force to the inner sleeve.

We claim:

1. Connection device in an ignition system for transferring current to the spark plugs of an internal combustion engine, each connection device (5) including a comparatively rigid outer sleeve (6) intended to surround an upper portion (8) of a spark plug, a contact means for conductive communication with a central electrode (13) of the spark plug, an elastic inner sleeve (7) surrounded by the outer sleeve (6) for tightly sealing against the upper portion (8) of the spark plug when the connection device (5) is fitted to the spark plug (3), a space (26) being formed between the outer sleeve (6) and the inner sleeve (7) for allowing radial expansion of the inner sleeve (7), characterized in that the outer sleeve (6) and the inner sleeve (7) have lower portions which include coacting portions for transferring force between the outer and inner sleeves (6,7), whereby for an upwardly directed force on the connection device (5) fitted to the spark plug, force is transferred from the outer sleeve to the inner sleeve (7), and causes the inner sleeve to relinquish the spark plug.

2. Connection device as claimed in claim 1, characterized in that the coacting portion of the outer sleeve (6) includes a radially inwardly projecting flange (30) at the lower end of the outer sleeve, acting axially on the inner sleeve (7) for an upwardly directed force on the connection device (2).

3. Connection device as claimed in claim 2, characterized in that the coacting portion of inner sleeve (7) includes a radially outwardly projecting flange (28) at the lower end of the inner sleeve, this flange coacting with the flange (30) of the outer sleeve (6).

4. Connection device as claimed in claim 1, characterized in that the connection device (5) is attached to a connection piece (2) included in an ignition unit (1).

5. Connection device as claimed in claim 4, characterized in that the outer sleeve (6) is arranged to be fitted to an element (9) included in the connection piece (2) with the aid of a snap-on joint (11).

6. Connection device as claimed in claim 5, characterized in that in an assembled condition an upper portion (25) of the inner sleeve (7) is acted on by an axial force from the outer sleeve (6) towards a bottom (21) formed in the ignition element (9).

7. Connection device as claimed in claim 6, characterized in that the upper portion (25) of the inner sleeve (7) is formed with a bead (23) complemental to an opening (22) in the bottom (21) to act as a plug for the opening when the portion (25) is compressed between the outer sleeve (6) and the bottom (21).

* * * * *